United States Patent [19]

Bowes

[11] Patent Number: 4,543,060

[45] Date of Patent: Sep. 24, 1985

[54] HEAT TREATMENT OF WORKPIECES

[75] Inventor: Robert G. Bowes, Kobe, Japan

[73] Assignee: The BOC Group plc, London, England

[21] Appl. No.: 578,386

[22] Filed: Feb. 8, 1984

[30] Foreign Application Priority Data

Feb. 10, 1983 [GB] United Kingdom ..... 8303673

[51] Int. Cl.[4] ..... F27B 9/04; F27B 3/22; F27B 5/04; F26B 3/00

[52] U.S. Cl. ..... 432/23; 34/36; 432/26; 432/37; 432/198

[58] Field of Search ..... 432/23, 26, 37, 198; 34/36, 37

[56] References Cited

U.S. PATENT DOCUMENTS

| | | | |
|---|---|---|---|
| 2,253,897 | 8/1941 | Doderer | 432/23 |
| 2,749,106 | 6/1956 | Ness | 432/23 |
| 3,852,026 | 12/1974 | Johansson | 432/23 |
| 4,391,585 | 7/1983 | Riley et al. | 432/23 |

*Primary Examiner*—John J. Camby

*Attorney, Agent, or Firm*—David L. Rae; Larry R. Cassett

[57] ABSTRACT

A continuous heat treatment furnace has an entrance, a preheat zone, a thermal treatment zone, a cooling zone and an exit. Curtains are provided at the entrance and exit respectively. Nitrogen and hydrogen (or other reducing gas) are supplied to the furnace to create a non-oxidizing or reducing atmosphere in the thermal treatment and cooling zones. Elongate workpieces such as tubes are advanced through the furnace and thereby heat treated (e.g. annealed). As the workpieces pass through the curtains so the tendency for air to leak into the furnace is increased. To counteract this tendency, position sensing plates are adapted to actuate a signal generator controlling a valve which in turn controls flow of e.g. nitrogen to the furnace. The arrangement is such that the flow of nitrogen to the furnace is increased wherever a workpiece is sensed, thereby enabling the essentially reducing or non-oxidizing character of the atmosphere to be sustained. If desired, the oxygen potential in the vicinity of the furnace entrance and exit can alternatively be monitored and used to modulate the flow of gas into the furnace.

10 Claims, 2 Drawing Figures

HEAT TREATMENT OF WORKPIECES

This invention relates to a method of and a furnace for continuous heat treatment of workpieces.

Our copending U.K. patent application No. 2108156 describes a method of heat treating (and particularly annealing) metal in a continuous furnace having in sequence an entrance, a thermal treatment region, a cooling region, and an exit, comprising the steps of substantially preventing or impeding the ingress of air into the furnace through the entrance and exit, introducing non-reactive gas (e.g. nitrogen) and reducing gas into the furnace to provide reducing (or non-oxidising) conditions with respect to the metal substantially throughout the furnace and atmospheres of different compositions and the thermal treatment in cooling regions; and passing metal through the furnace from the entrance to the exit so as to effect the treatment. Typically, when, for example, annealing, a part of the cooling region near to the furnace exit has spaced-apart curtains or partitions defining a plurality of chambers adapted to permit metal to pass therethrough. Nitrogen or other non-reactive gas is introduced into the chambers so as to limit the ingress of air into the furnace through the exit. A similar arrangement of chambers is typically employed at the entrance to the furnace so as to limit the ingress of air into the furnace through the entrance. A flow of gas through the furnace from the exit to the entrance is established and thus the gas flow out of the thermal treatment region of the furnace is substantially in the direction of the entrance rather than the exit. Typically, when annealing, reducing gas which may be hydrogen or a hydrocarbon such as methane or propane is supplied to the thermal treatment region and nitrogen to the cooling region so as to create, on average, a higher concentration of reducing gas in the annealing region rather than in the cooling region.

It is possible to make substantial reductions in the total consumption of gas in a conventional mesh-belt or roller hearth continuous furnace by employing the above described method. It is alternatively or additionally possible to maintain a large concentration of reducing gas in the main part of the cooling zone while causing a non-flammable atmosphere to be discharged from the exit of the furnace without having to resort to the expedient of burning the reducing gas at or near the furnace exit. Typically, in the method according to the aforesaid co-pending application we burn-off gas only near to the entrance to the furnace if at all.

When for example annealing large diameter (e.g. 200 mm) cold drawn tubes by the method according to the co-pending application we have found that the demand for gas is significantly greater than when annealing small diameter (e.g. 20 mm) tubes in the same furnace. This is because more gas is needed to counteract the greater tendency for air to reach the thermal treatment region when the curtain or curtains are displaced by the work. It is now found that the requirements for the supply of gas to the furnace vary according to the size and shape of the workpieces being treated and whether or not at any one time the curtains at the exit to the furnace and (generally, less importantly) the entrance are being displaced by workpieces passing through the furnace.

According to the present invention there is provided a method of heat treating workpieces in a continuous furnace having an entrance, a thermal treatment region, a cooling region, and an exit, and also having at its entrance and/or exit at least one curtain (as hereinafter defined) comprising the steps of supplying reducing gas and non-reactive gas to the furnace to create in the thermal treatment and cooling regions an atmosphere or atmospheres essentially reducing or non-oxidising to the workpieces, and passing workpieces through the furnace to effect the desired treatment, wherein the flow of gas into the furnace is varied in response to means for detecting a workpiece entering or leaving the furnace, or to a change in the furnace atmosphere caused by a workpiece entering or leaving the furnace, the flow of gas being increased on detection of a workpiece or a change in the furnace atmosphere to a value greater than a minimum which prevails or would prevail when no such workpiece or change is detected, whereby to counteract the greater propensity for air to enter the furnace when a workpiece displaces or disturbs said curtain and thereby to maintain the essentially reducing or non-oxidising character of the atmosphere in the cooling and thermal treatment regions of the furnace. Preferably, means for detecting a workpiece (and curtains) are provided at both the entrance and exit of the furnace, the arrangement generally being such that the flow rate of gas into the furnace is greater than when a workpiece or change in furnace atmosphere caused by an inleak of air is detected at one of these locations only.

The invention also provides a furnace suitable for performing the said method of heat treating workpieces, having a thermal treatment region, a cooling region, and an exit; and also having at its entrance and/or exit at least one curtain (as hereinafter defined), at least one inlet for supplying non-reactive gas and reducing gas to the furnace, valves for controlling the flow of non-reactive and reducing gas to the furnace, and means for detecting the presence of a workpiece adjacent to the entrance and/or exit, or for detecting a change in the furnace atmosphere, said detecting means being operatively associated with at least one of the valves whereby the total flow rate of gas into the furnace is able to be varied according to whether or not a workpiece or change is detected.

Preferably, the association of the detection means with said valve or valves is such that the size of the increase of variation in the flow rate may be chosen in accordance with the diameter or cross sectional area of the workpieces to be heat treated.

The term "heat treating" as used in the specification includes within its scope annealing, brazing, sintering, normalising, malleablising spheroidising and normalising of typically metal workpieces.

The term "curtain" as used herein means any device or means which obstructs or obturates the flow of gas out of the furnace but which permits workpieces to pass therethrough or therebeneath. The term is broad enough to encompass pivoted metal plates or flaps, baffles, pieces of heat resistant fabric or ceramic, arrangements of filaments or fibres of ceramic or other material, and any other device or member which is able in opeation to obstruct or obturate the entrance or exit to the furnace and thereby substantially inhibit the ingress of air into the furnace through such entrance or exit.

The curtains may typically hang or depend vertically or at a small angle to the vertical. Typically, spaced apart, generally vertical curtains are employed at both the entrance and exit to the furnace. At the exit, it is particularly desirable to employ a plurality of curtains and to supply non-reactive gas such as nitrogen to the space or spaces between the curtains so as to provide a flow or pressure of non-reactive gas that inhibits the inleak or infiltration of air into the furnace through the curtains. Typical arrangements of curtains are described in our aforesaid co-pending application. The non-reactive gas is typically nitrogen but could for example be one of the noble gases such as argon.

The reducing gas may be nitrogen. It can be supplied from a pure source of hydrogen or an externally generated source such as cracked ammonia. It may also be generated by the in situ decomposition of a hydrocarbon (e.g. propane) or an alcohol or other organic liquid or vapour thereof.

In typical embodiments of the invention, the detection means comprises an actuator displacable by a workpiece to actuate a valve controlling the flow of gas into the furnace. Although it is possible to have direct actuation, it is preferred that the actuation be indirect through, for example, electrical or electronic circuit or circuits. In one arrangement, the actuator may be adapted to operate a rheostat controlling the motor of a motorised valve. By this means, it is possible to arrange for the setting of the valve to be variable with the diameter or cross-sectional area of the workpieces.

In alternative arrangements, the workpieces detection means may be adapted to actuate more than one valve. For example, the flow of gas into the furnace may be varied in steps according to the number of solenoid valves that are open. Displacement of the actuator can be arranged to operate a cam which according to its position is able to cause different numbers of valves, for example solenoid valves to close.

It is not necessary for detection means to employ an actuator displacable by a workpiece. Ultrasonic or microwave detectors may, for example, alternatively be employed.

As an alternative to detecting directly the position of the workpiece, a parameter associated with the furnace atmosphere may be monitored, and a change in the chosen parameter used to cause the required change in the flow rate of gas into the furnace. For example, the oxidation potential of the atmosphere may be monitored in the thermal treatment region of the furnace. This is not preferred however as changes in the oxidation (or oxygen) potential take place as a result of changes in the rate at which air "leaks" into the furnace, it being desirable to increase the flow rate of non-reactive gas and/or reducing gas into the furnace so as to prevent or minimise such inleak of air rather than in response to it. Since the pressure in the furnace is generally above atmospheric pressure, disturbance of the curtains particularly by a large diameter tube will tend to lead first to a reduction in the pressure in the furnace by causing an increased flow rate of gas out of the furnace and then to an increased inleakage of air. It is thus possible to monitor the decrease in pressure to cause an increase in the rate of gas supply to the furnace.

A preferred alternative or additional measure to monitoring the oxygen potential of the atmosphere in the said thermal treatment region is to monitor such oxygen potential (or another parameter) at or near one or both the entrance to and exit from the furnace and to provide suitable means for so doing. The resulting signals may be transmitted to control means effective to control valve(s) controlling the flow of gases into the furnace. It is possible to monitor other parameters than oxygen potential that are related to the inleak of atmospheric oxygen into the furnace. For example, carbon dioxide and hydrogen concentrations can alternatively be monitored at such locations.

Typically, the rate of supply of non-reactive gas to the cooling region (other than to part of the cooling region defined by spaced apart curtains) or the thermal treatment region itself is increased and the supply of reducing gas to the furnace kept constant. It is alternatively possible to keep the supply of nitrogen constant and vary the supply of hydrogen. However, when, say, annealing relatively small flow rates only of hydrogen are typically required and therefore adjustment of such rate of flow in order to compensate for a varying inleak of air into the furnace may be unduly wasteful of relatively expensive reducing gas. It is to be appreciated that an increased rate of supply of nitrogen and/or other non-reactive gas will increase the pressure in the thermal treatment region and thus provide a greater back-pressure against the inflow of air into the thermal treatment region than would take place were there to be no increase in the rate of gas supply to the thermal treatment regions.

The method and furnace according to the invention can now be described by way of example with reference to the accompanying drawings, in which.

Figure 1:
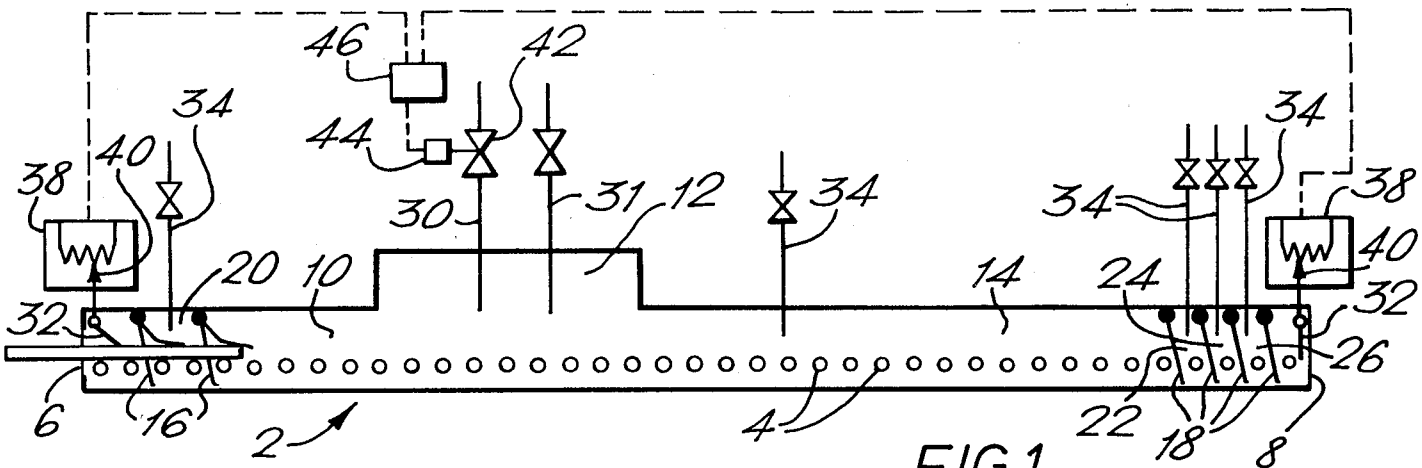
FIG. 1 is a schematic drawing of the roller hearth furnace for use in accordance with the invention.

Referring to FIG. 1 of the drawings, a continuous furnace 2 has a roller hearth 4 which is operable to convey elongate workpieces such as tubes through the furnace. The hearth 4 extends from the entrance 6 to the exit 8 of the furnace. In sequence, from the entrance 6 to exit 8 there is a pre-heat zone 10 in which workpieces being advanced through the furnace are pre-heated by relatively hot gas, and a hot zone or thermal treatment zone 12 which is heated by means (not shown) to a suitable thermal treatment temperature. The treatment temperature will be chosen in accordance with the nature of the treatment and the composition of the workpieces. From hot zone 12 the workpieces pass to a cooling zone 14 in which they are gradually reduced in temperature by contact with relatively low temperature gas. Typically, the workpieces will leave the furnace at a temperature not significantly above ambient.

The entrance and exit are fitted with arrangements 16 and 18 of curtains. There may be two spaced apart generally vertical curtains 16 at the entrance defining therebetween a chamber 20 and four such curtains at the exit defining chambers 22, 24 and 26. Each curtain comprises a multitude of generally vertically depending fibres or filaments of heat resistant material such as fibre glass, which, when not displaced, substantially prevents the passage of gas therethrough. Typically, each curtain extends below the level of the hearth 4 to minimise the amount of gas passage through the furnace therebeneath. Alternatively, the curtains may extend down to the rolls, and other means employed to impede the inleakage of air below the rolls (e.g. the space between the rolls and the bottom of the furnace can be filled with mica granules). The passage of tubes or other elongate workpieces through the furnace displaces the individual filaments of glass and thereby disrupts the curtain sufficiently to cause gas to flow therethrough around the workpieces. In addition, in the instance of tubes there is a direct conduit provided for the flow of gas into and out of the furnace through the hollow interiors of the tubes.

In order to provide a suitable annealing atmosphere in the hot zone 12 of the furnace, nitrogen and hydrocarbon (or hydrogen) are admitted to the hot zone through inlets 30 and 31 respectively. The hydrocarbon may be methane or propane and will "crack" to yield hydrogen in the furnace. In addition, there are inlets 34 for nitrogen positioned so as to supply such nitrogen directly to each of the chambers 20, 22, 24 and 26. There is also a nitrogen inlet 34 to the cooling zone 14. The relative rates of flow gas into the furnace are chosen so as to create a significantly greater gas pressure in the cooling zone 14 in the preheat zone 10. Thus, there is a substantially greater flow of hot gas out of the hot zone in the direction of the entrance 6 than in the direction of the exit 8. Moreover, in view of this flow regime there is a greater concentration of hydrogen in the hot zone 12 than in the cooling zone 14. The supply of nitrogen to the chambers 20 to 26 helps to limit substantially or prevent the ingress of air into the furnace through the entrance and exit thereof when the curtains are not displaced by workpieces such as tubes passing therethrough. If necessary, hydrogen may also be supplied directly to the cooling zone.

Figure 2:
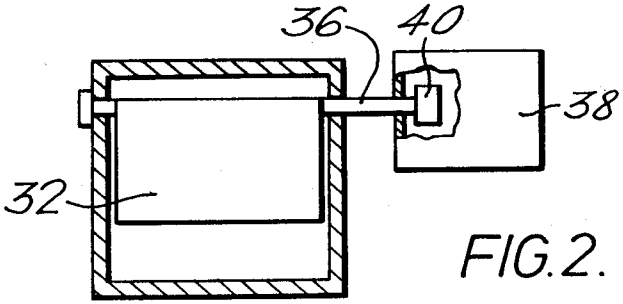
FIG. 2 shows a detector associated with an end chamber forming part of the furnace shown in FIG. 1.

Near to the entrance 6 of the furnace 2 is positioned a plate 32 which normally depends generally vertically from a shaft 36 to which it is fixed. The shaft 36 is able to be rotated in slots 36 in opposite walls of the furnace. In addition, the shaft 36 extends through one of the walls into a signal generator 38 (see FIG. 2). Displacement of the plate 32 by a workpiece rotates the shaft 36. The end of the shaft 36 in the signal generator 38 operates a rheostat 40 (see FIG. 2) which forms part of a circuit that provides a control signal for a motorised valve 42 (having a motor 44) controlling flow of nitrogen into the hot zone 12 of the furnace. An analogous arrangement of plate, shaft and signal generator is provided at the exit from the furnace.

In operation, the degree of displacement of the plate dictates the degree of rotation at the shaft 36 and hence the setting of the rheostat 40. Thus, a relatively small diameter tube may displace the plate at the entrance to the furnace sufficient to increase the flow rate of gas through the valve 42 by a chosen unit amount, whereas a larger tube may displace the plates sufficiently to increase the flow rate through the valve 42 by two units.

Typically, there is a signal generator employed with both the entrance and the exit so that if a tube extends through the entrance when another tube extends through the exit, the control signals generated may be added together. For this purpose, there is generally a valve controller 46 positioned between the valve 42 and the two signal generators 40.

The valve controller 46 provides control signals for the valve 42 dependent upon the inputs from the signal generators 38. When the curtains are undisturbed by tubes entering and leaving the furnace (and hence when the plates 32 are not displaced) the valve 42 has a setting corresponding to a chosen minimum flow rate of gas. Displacement of one of the plates 32 by a workpiece produced a change in the signal generated by its associated signal generator 38 by virtue of the operation of the associated rheostat 40. The size of the change depends on the size of the angle through which the plate 32 is displaced and therefore on the diameter of the tube itself, the valve controller 46 being arranged to actuate the motor 44 of the valve 42 in steps that correspond to different tube diameters.

I claim:

1. A method of heat treating workpieces in a continuous furnace having an entrance, a thermal treatment region, a cooling region, and an exit and at least one curtain located at said entrance or exit comprising the steps of:

(a) supplying reducing gas or non-oxidizing gas to at least one location in said furnace remote from said curtain to form in said thermal treatment and cooling regions an atmosphere which is essentially reducing or non-oxidizing to said workpieces;

(b) passing said workpieces through the furnace to effect the desired heat treatment with said workpieces disturbing said said curtain upon passage into or from said furnace;

(c) establishing a flow rate of said reducing and non-oxidizing gas at a level when said curtains are not disturbed by passage of said workpieces through said furnace sufficient to maintain a substantially non-oxidizing or reducing atmosphere in said furnace;

(d) detecting disturbance of said curtain by said workpieces; and (e) increasing the flow rate of said gas upon detecting a disturbance of said curtain such that the atmosphere in said cooling and thermal treatment regions of said furnace is maintained substantially reducing or non-oxidizing.

2. The method defined in claim 1 wherein at least one curtain is disposed at said entrance and at said exit and wherein the step of detecting disturbance of said curtain comprises detecting disturbances of at least one of said entrance curtains and at least one of said exit curtains.

3. The method defined in claim 2 wherein the step of increasing said flow rate comprises varying said flow rate in accordance with the cross-sectional area of said workpieces such that said substantially non-oxidizing or reducing atmosphere is maintained in said furnace.

4. Apparatus for heat treating workpieces in a continuous furnace having an entrance, a thermal treatment region, a cooling region, and an exit and at least one curtain located at said entrance or exit comprising;

(a) means for supplying reducing gas and non-reactive gas to at least one location in said furnace remote from said curtain to form in said thermal treatment and cooling regions an atmosphere which is essentially reducing or non-oxidizing to said workpieces;

(b) means for passing said workpieces through the furnace to effect the desired heat treatment with said workpieces disturbing said said curtain upon passage into or from said furnace;

(c) means for detecting disturbance of said curtain by said workpieces; and (d) means responsive to said detecting means for increasing the flow rate of said reducing or non-oxidizing gas supplied to said furnace upon detection of said disturbance of the curtain such that a substantially non-oxidizing or reducing atmosphere is maintained in said furnace.

5. The apparatus defined in claim 4 wherein said means for supplying said reducing or non-oxidizing gas comprise a valve means having an adjustable opening and said means for detecting said disturbance of said curtain comprise an actuator coupled to said curtain and to said valve means.

6. The apparatus defined in claim 5 wherein the degree of opening of said valve means is varied by said actuator in accordance with the cross-sectional area of the workpieces being passed through said furnace.

7. The apparatus defined in claim 5 wherein the valve means is a motorized valve and said means responsive to said detecting means comprise a rheostat coupled between said actuator and the motor of said motorized valve.

8. The apparatus defined in claim 4 wherein a curtain is disposed at said entrance and at said exit of said furnace.

9. The apparatus defined in claim 4 wherein said workpieces are tubes.

10. The apparatus defined in claim 4 wherein said non-oxidizing gas is nitrogen.

* * * * *